US009707425B2

(12) United States Patent
Schwartz

(10) Patent No.: US 9,707,425 B2
(45) Date of Patent: Jul. 18, 2017

(54) PADDED POLE VAULT PLANT BOX

(71) Applicant: UCS, INC., Lincolnton, NC (US)

(72) Inventor: Jeffrey Schwartz, Alpine, NJ (US)

(73) Assignee: UCS, INC., Lincolnton, NC (US)

( * ) Notice: Subject to any disclaimer, the term of this patent is extended or adjusted under 35 U.S.C. 154(b) by 0 days.

(21) Appl. No.: 14/687,688

(22) Filed: Apr. 15, 2015

(65) Prior Publication Data

US 2015/0335929 A1 Nov. 26, 2015

Related U.S. Application Data

(60) Provisional application No. 61/980,362, filed on Apr. 16, 2014.

(51) Int. Cl.
*A63B 5/06* (2006.01)
*A63B 71/00* (2006.01)

(52) U.S. Cl.
CPC ..... *A63B 5/06* (2013.01); *A63B 71/0054* (2013.01)

(58) Field of Classification Search
CPC ..... A63B 2244/08; A63B 2244/081; A63B 2244/082; A63B 2244/084; A63B 2244/085; A63B 2244/087; A63B 5/00; A63B 5/06; A63B 6/00; A63B 2244/12; A63B 2225/093; A63B 6/02; A63B 5/02
USPC ..... 482/14–19, 23, 25–26
See application file for complete search history.

(56) References Cited

U.S. PATENT DOCUMENTS 2,110,254 A * 3/1938 Austin ..... A63B 5/06 482/18
3,075,765 A * 1/1963 Mpakarakes ..... A63B 5/06 482/18
3,948,514 A * 4/1976 Von Holt ..... A63B 5/06 482/18
3,965,507 A * 6/1976 Reiland ..... A63B 6/02 482/15
4,163,551 A * 8/1979 Simpson ..... A63B 5/06 482/18
4,245,838 A * 1/1981 Gordon ..... A63B 6/02 482/15

(Continued)

FOREIGN PATENT DOCUMENTS

JP H10 179792 A 7/1998

OTHER PUBLICATIONS

International Search Report and Written Opinion for PCT/US2015/024002, completed Jun. 30, 2015.

*Primary Examiner* — Andrew S Lo
(74) *Attorney, Agent, or Firm* — Moore & Van Allen PLLC; W. Kevin Ransom

(57) ABSTRACT

Embodiments of the invention are directed to an assembly for engaging an end of a vaulting pole, wherein the assembly comprises a support frame configured to be at least partially recessedly installed in the ground. A platform is connected to the support frame and comprises a top surface comprising a pole vault plant box comprising an angled planar surface with left, rear, and right side walls extending upwardly from the planar surface, wherein the pole vault plant box is configured to enable receipt of an end of a vaulting pole during a pole vault plant; at least one padding tray surrounding a perimeter of the pole vault plant box, wherein the padding tray is configured to receive a padding; and a bottom surface of the platform operatively coupled to the support frame.

19 Claims, 5 Drawing Sheets

(56) References Cited

U.S. PATENT DOCUMENTS

| | | | | |
|---|---|---|---|---|
| 4,351,413 | A * | 9/1982 | Simon | A63B 6/02<br>182/139 |
| 4,443,009 | A * | 4/1984 | Smith | A63B 5/06<br>482/15 |
| 8,444,531 | B1 | 5/2013 | Johnson et al. | |
| 2004/0053747 | A1 | 3/2004 | Bollinger | |
| 2004/0067820 | A1 | 4/2004 | Noble et al. | |
| 2014/0135177 | A1* | 5/2014 | Schwartz | A63B 5/06<br>482/18 |
| 2015/0080185 | A1* | 3/2015 | Johnson | A63B 5/06<br>482/18 |

* cited by examiner

PADDED POLE VAULT PLANT BOX

CROSS-REFERENCE TO RELATED APPLICATION(S)

This application is a non-provisional application of and claims priority to U.S. Provisional Patent Application No. 61/980,362, entitled PADDED POLE VAULT PLANT BOX, and filed Apr. 16, 2014, the contents of which are hereby incorporated by reference herein.

TECHNICAL FIELD

A pole vault plant box with frame configured to receive padding is disclosed.

BACKGROUND

There is a need to protect an athlete from injury when the athlete undertakes a pole vault jump. Most current vault boxes do not provide proper padding to mitigate potential injury.

BRIEF SUMMARY

In one embodiment, an assembly for engaging an end of a vaulting pole is provided. The assembly comprises a support frame configured to be at least partially recessedly installed in the ground. A platform comprises a top with a pole vault plant box comprising an angled planar surface with left, rear, and right side walls extending upwardly from the planar surface, wherein the pole vault plant box is configured to enable receipt of an end of a vaulting pole during a pole vault plant. At least one padding tray surrounds a perimeter of the pole vault plant box, wherein the padding tray is configured to receive a padding. A bottom surface of the platform is operatively coupled to the support frame.

In some embodiments, a portion of the at least one padding tray is located adjacent to a front edge of the planar surface of the pole vault plant box, so as to accommodate padding in front of the pole vault plant box.

In some embodiments, the left, right, and rear, side walls extend at angles upwardly from the planar surface of the pole vault plant box and the left and right side walls extend at angles $\alpha$ horizontally from respective ends of a rear edge of the planar surface, respectively toward to the perimeter of the padding tray, thereby creating horizontally slanted walls that angle from a front edge to the rear edge of the planar surface of the pole vault plant box.

In some embodiments, a portion of at least one padding tray is located adjacent to a front edge of the planar surface of the pole vault plant box, so as to accommodate padding in front of the pole vault plant box, wherein left and right side walls are defined in the padding tray and extend upwardly from a padding tray planar surface at an angle and extend at angles $\beta$ horizontally from respective ends of a rear edge of the padding tray planar surface, respectively toward the perimeter of the padding tray, thereby creating horizontally slanted walls that angle from a front edge to the rear edge of the padding tray planar surface of the padding tray.

In some embodiments, the left, right, and rear, side walls extend at angles upwardly from the planar surface of the pole vault plant box and the left and right side walls extend at angles $\alpha$ horizontally from respective ends of a rear edge of the planar surface, respectively toward to the perimeter of the padding tray, thereby creating horizontally slanted walls that angle from a front edge to the rear edge of the planar surface of the pole vault plant box. Further, a portion of the at least one padding tray is located adjacent to a front edge of the planar surface of the pole vault plant box, so as to accommodate padding in front of the pole vault plant box, wherein left and right side walls are defined in the padding tray and extend upwardly from a padding tray planar surface at an angle and extend at angles $\beta$ horizontally from respective ends of a rear edge of the padding tray planar surface, respectively toward the perimeter of the padding tray, thereby creating horizontally slanted walls that angle from a front edge to the rear edge of the padding tray planar surface of the padding tray. Further, rear ends of the left and right side walls of the second padding tray are offset horizontally by a distance from respective front ends of the left and right side walls of the planar surface of the pole vault plant box.

In some embodiments, the platform defines front and rear sides connected by right and left sides so as to form a platform perimeter, wherein the at least one padding tray is defined within the platform perimeter, wherein the at least one padding tray comprises a first and second padding tray.

In some embodiments, the first and second padding trays are recessed in respect to a top surface of the platform perimeter and are configured to receive at least one padding.

In some embodiments, the planar surface has a first end adjacent a rear edge of the second padding tray, and wherein the planar surface extends downwardly at an angle from rear edge of the second padding tray toward the rear side of the platform perimeter.

In some embodiments, the platform comprises at least one side wall having an end connected to the planar surface, wherein the side wall is angled relative to the planar surface and extending upwardly and outwardly therefrom at an angle with respect to said planar surface from said planar surface and towards the top surface of the platform.

In some embodiments, the at least one side wall extends for an extending portion above the top surface of the platform.

In some embodiments, the platform comprises a rear wall having an end connected to a second end of the planar surface, the rear wall extending upwardly with respect to the second end of said planar surface and towards the top surface of the platform.

In some embodiments, the rear wall extends for an extending portion above the top surface of the platform.

In some embodiments, first padding tray is offset vertically above the second padding tray.

In some embodiments, the assembly comprises padding located in the first and second padding trays, wherein at least a portion of the padding located in the second padding tray is thicker than at least a portion of the padding located in the first padding tray such that a top surface of the padding is substantially flush when installed in said platform.

In some embodiments, the assembly comprises padding located in the first and second padding trays, wherein the padding is continuous in form.

In some embodiments, the support frame comprises a top surface and a rear wall configured to receive the bottom surface of the platform, and a bottom surface and a rear side wall configured to stabilize the support frame within the ground.

In some embodiments, the planar surface extends a downward angle such that when installed in the support frame the planar surface is adjacent to the top surface of the support frame, and a rear wall of the platform is adjacent to the rear wall of the support frame.

In some embodiments, the planar surface is angled downward to a depth of 8.25 inches below a horizontal plane defined from the first end of said planar surface.

In some embodiments, the at least one padding tray includes means for coupling padding to said padding tray, wherein said means for coupling comprises at least one of a pin, a screw, an adhesive, Velcro®, a lock, a tab, and a compressing pin.

In some embodiments, the padding includes a layer of rigid material on its bottom surface so as to the enable the secure coupling of the padding to the platform, wherein said the padding is coupled to the platform via at least one of a pin, Velcro®, a lock, a compressing pin, a tab, an adhesive, and a screw.

In some embodiments, the padding is configured to receive an adjacent landing pad, wherein the landing pad is configured to substantially overlap a top surface of the padding.

In some embodiments, upon installation the top surface of the padding is substantially flush with a top surface of the adjacent landing pad.

In another aspect, the present invention is directed to an assembly for engaging an end of a vaulting pole that comprises a platform comprising a top surface having a planar surface configured to enable receipt of an end of a vaulting pole during a pole vault plant, and at least one padding tray adjacent to a perimeter of said planar surface, wherein the padding tray is configured to receive a padding.

In some embodiments, the assembly further comprises a support frame configured to be at least partially recessedly installed in the ground, wherein the platform is operatively connected to the support frame.

In some embodiments, the support frame comprises a top surface and a rear wall configured to receive the bottom surface of the platform, and a bottom surface and a rear side wall configured to stabilize the support frame within the ground.

In some embodiments, the platform defines front and rear sides connected by right and left sides so as to form a platform perimeter, wherein the at least one padding tray is defined within the platform perimeter, wherein the at least one padding tray comprises a first and second padding tray.

BRIEF DESCRIPTION OF THE DRAWINGS

Figure 1:
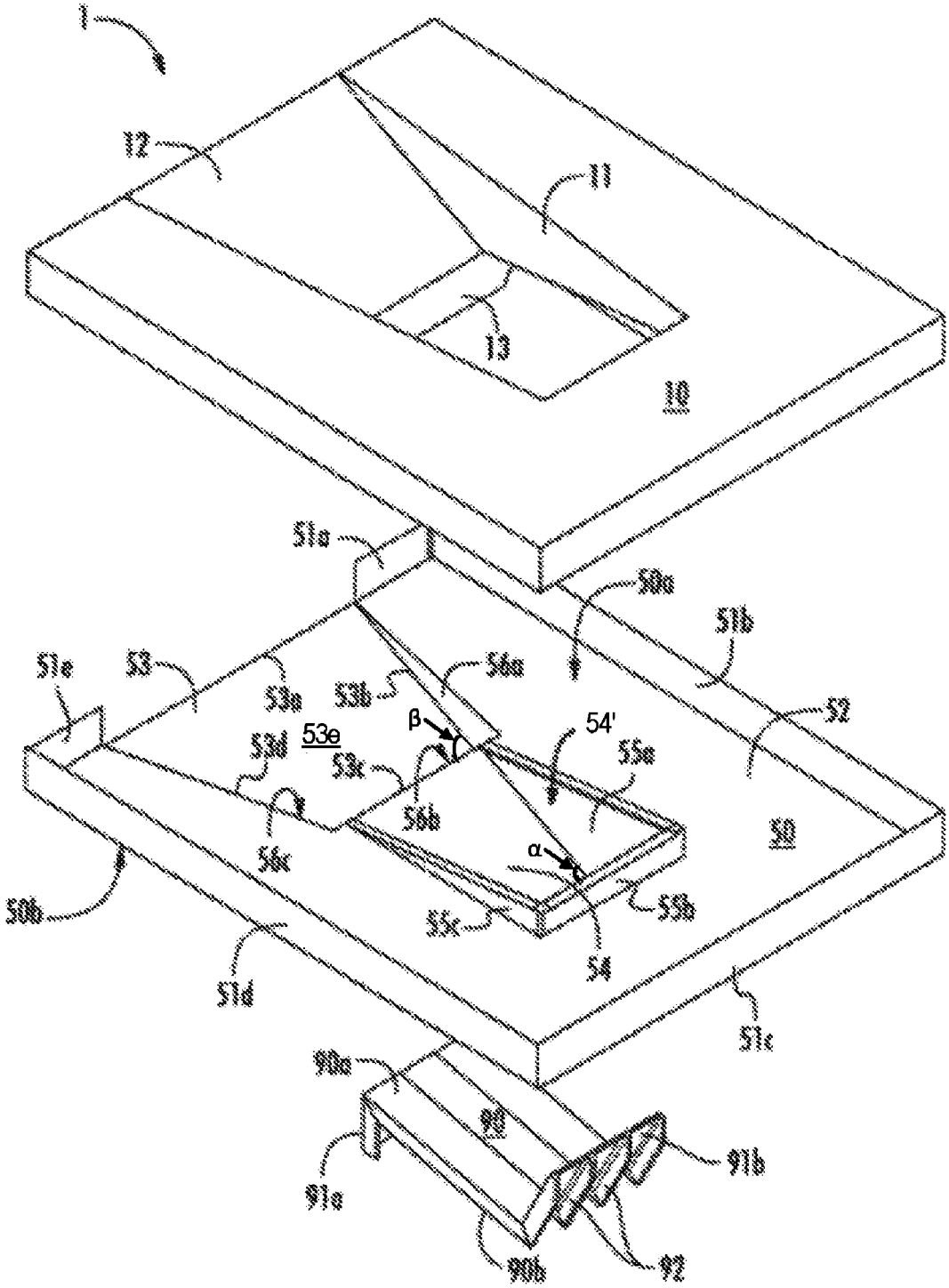
Figure 2:
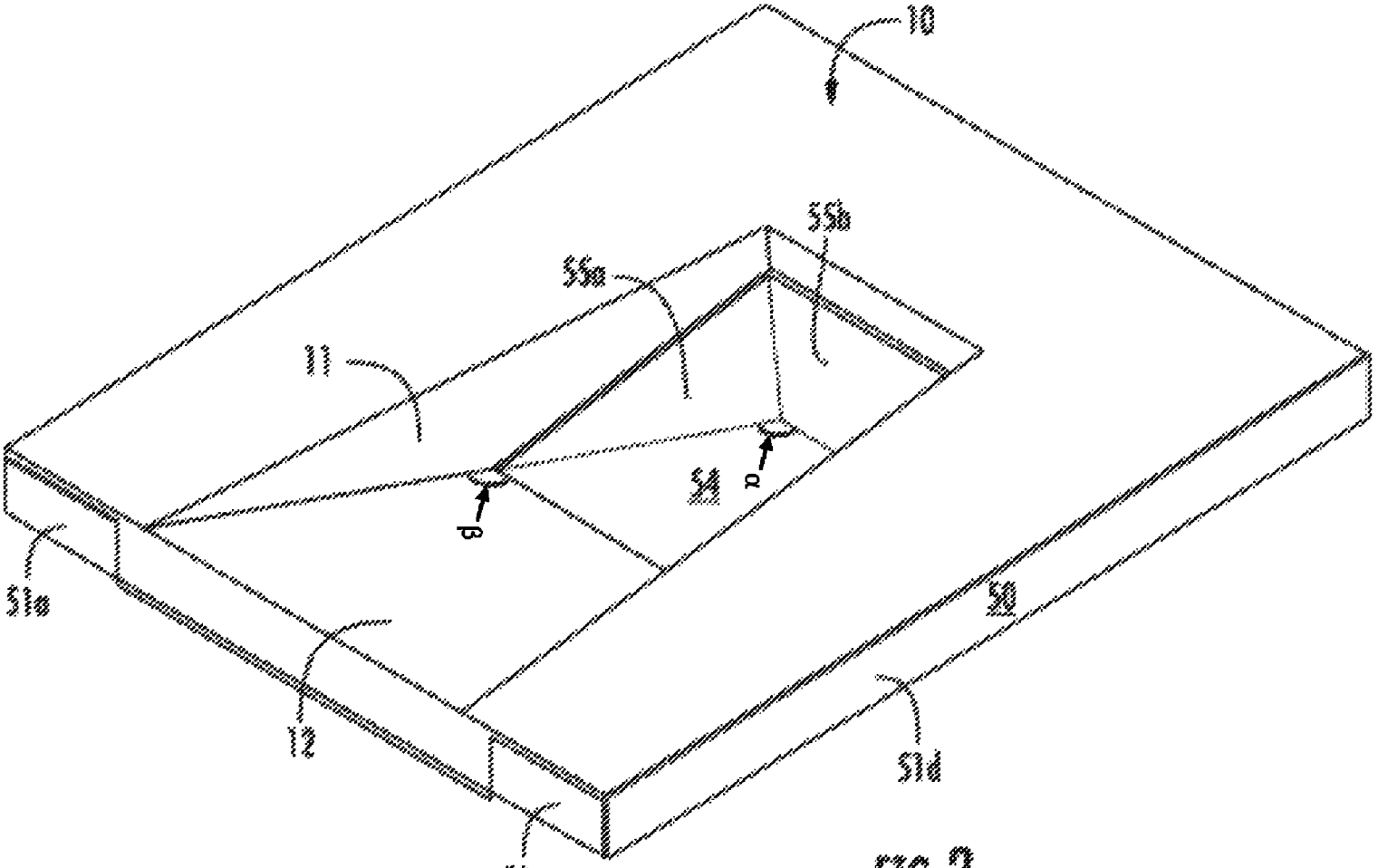
Figure 3:
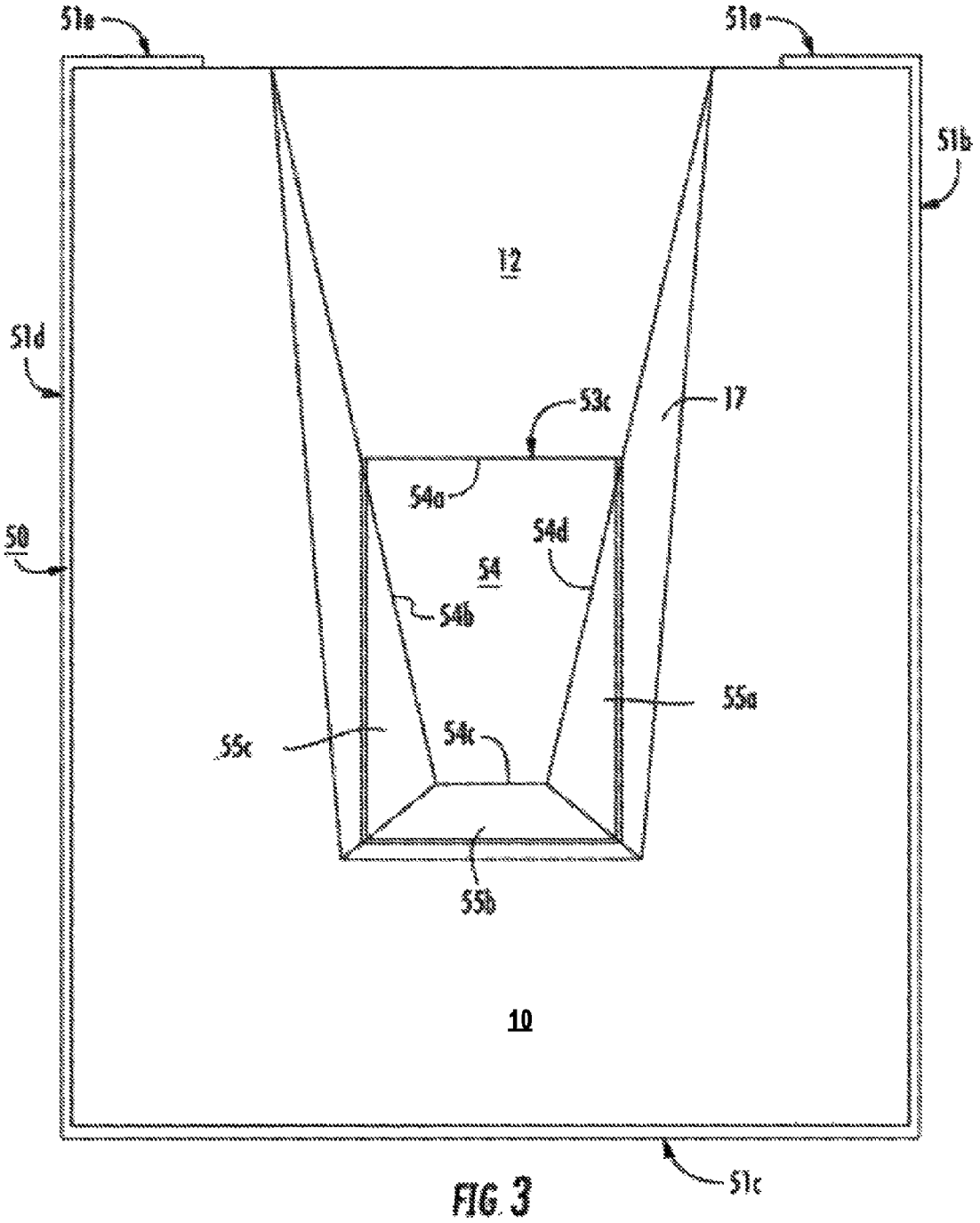
Figure 4:
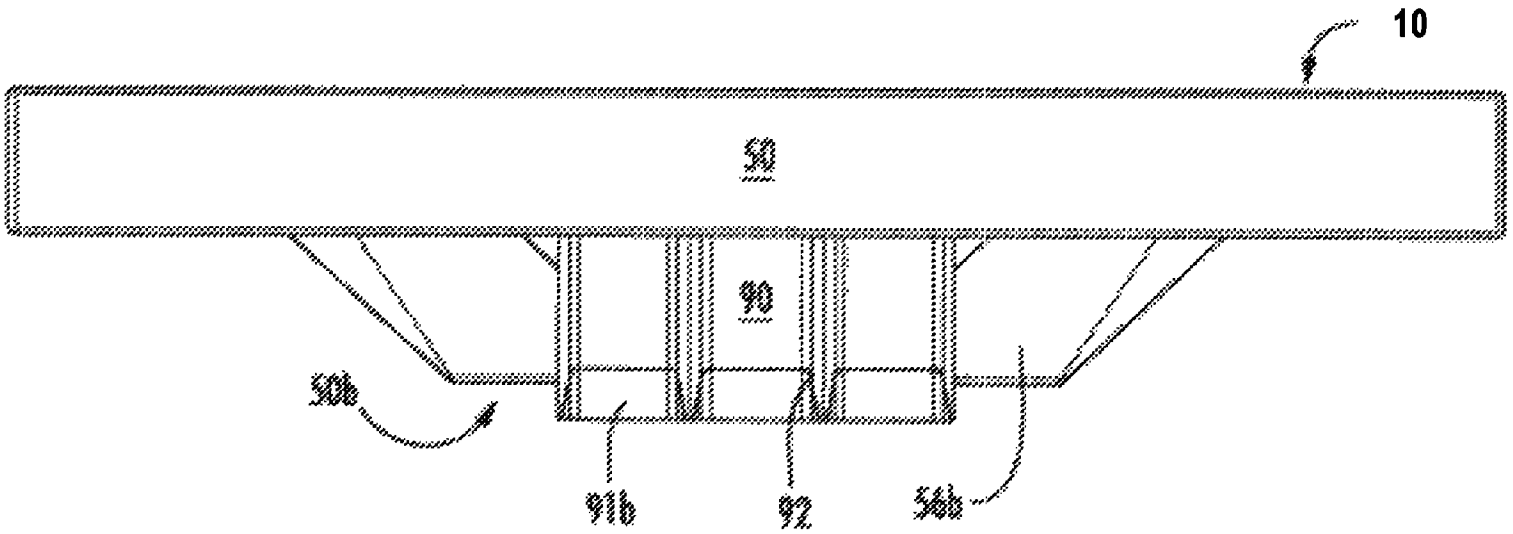
Figure 5:
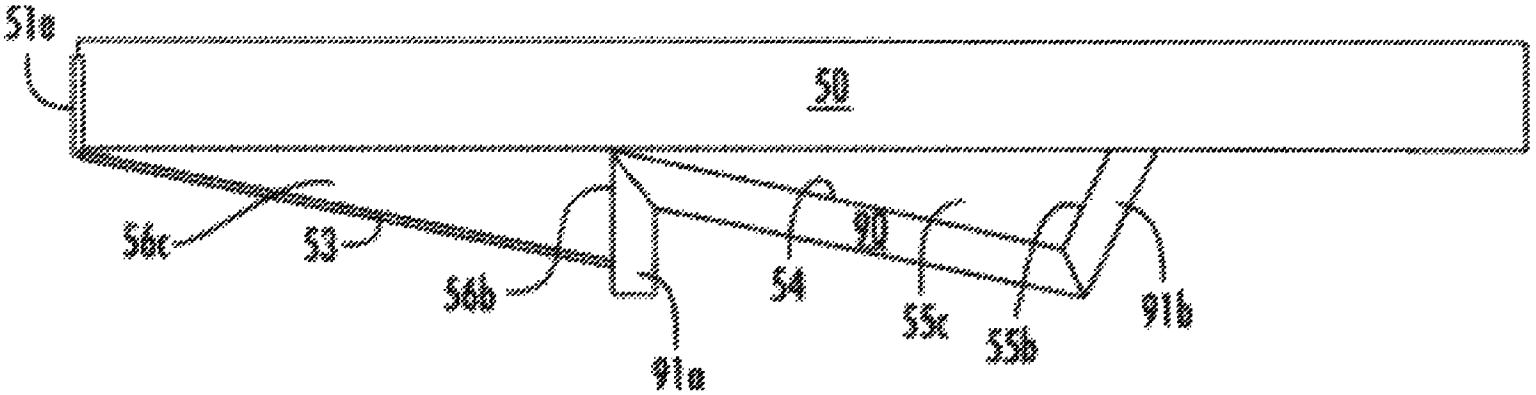

Having thus described embodiments of the invention in general terms, reference will now be made to the accompanying drawings, where:

FIG. 1 depicts an exploded perspective illustration of a pole vault plant box assembly, in accordance with an embodiment of the present invention;

FIG. 2 depicts a perspective illustration of the pole vault plant box assembly of FIG. 1 as assembled;

FIG. 3 depicts a top view of the pole vault plant box assembly of FIG. 1 as assembled;

FIG. 4 depicts a rear side view of the pole vault plant box assembly of FIG. 1 as assembled; and FIG. 5 depicts a right side view of the pole vault plant box assembly of FIG. 1 as assembled.

DETAILED DESCRIPTION OF EMBODIMENTS OF THE INVENTION

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

When an athlete undertakes a pole vault jump, he/she plants one end of a vaulting pole into a pole vault plant box while holding on to the opposite end of the vaulting pole. The vaulting pole, bending under force, catapults the athlete upwards into the air and over a horizontal bar, which, based on its height above ground, measures the height of the jump. After clearing the bar, the athlete lands safely on a soft landing pad located on an opposite side of the bar from that of the vault box. The landing pad includes padding to cushion the athlete's fall and therefore minimize injury. The landing pad is sized to align with the vaulter as they clear the horizontal bar. However, the landing pad may not be designed to protect the vaulter, if the vaulter falls short of the horizontal bar or experiences issues once the vaulter has engaged the vault box. Added security features are needed to address this issue.

In general, the present invention that provides a pole vault plant box that includes padding not only along the perimeter of the sides and rear top surfaces of the pole vault plant box, but also padding in front of the pole vault plant box. The padding in front of the pole vault plant box is angled to conform to the bottom planar surface of the pole vault plant box so as to allow for the end of the pole vault to enter the pole vault plant box unobstructed by the padding.

With reference to FIG. 1, the present invention relates to a pole vault plant box assembly 1 that is configured for engaging an end of a vaulting pole during the pole vault process. The pole vault plant box assembly 1 comprises, in general, three components: 1) a layer of protective padding 10, 2) a platform 50, and 3) a support frame 90. The platform 50 includes a pole vault plant box 54' that is defined by a bottom planar surface 54, and right, rear, and left side walls 55*a*-55*c*. The pole vault plant box 54' is configured for engaging an end of a pole vault inserted by a vaulter during the pole vaulting process. The platform 50 defines padding trays 52 and 53 that retain padding about a perimeter of the pole vault plant box 54'. The layer of protective padding 10 is provided around the vaulting pole's planting surface so that an athlete's fall may be appropriately cushioned. The layer of protective padding 10 is generally positioned adjacent to at least a portion of the top surfaces (52, 53) of the platform 50 of the pole vault plant box assembly 1. The support frame 90 is provided for supporting the platform 50 within the ground or other rigid surfaces.

As illustrated in FIG. 1 and further described below, the pole vault plant box assembly 1, comprises two defined top surfaces 52 and 53 for receiving padding, with one of the surfaces 53 being positioned in front of a planar surface 54, where the planar surface 54 is configured to receive an end of the pole vault pole during vaulting. The surface 53 in front of the planar surface 54 is configured to receive padding 12 to provide added safety to the vaulter. Further, in some embodiments, the planar surface 54 of the pole vault plant box 54' defined in the frame 50 includes rear 55*b* and left and right side walls (55*a*, 55*c*) that extend above the top surface 50*a* of the platform 50. This allows for added/thicker padding 10 around the planar surface 54 with increased padding support about the perimeter of the planar surface, and increased wall heights (55*a*, 55*b*, 55*c*) around the planar surface to better support and retain the end of the pole vault pole during vaulting.

Regarding the platform 50 of the pole vault plant box assembly 10, it may be constructed of bent and welded sheet metal, metal casting, a metal alloy, titanium, aluminum, steel, iron, plastic, fiberglass, carbon fiber, a composite, or another rigid material. The platform 50 is defined by front, left, rear and right side walls (51*a*-51*e*, respectively) that extend generally vertically from a top surface 50*a* of the platform 50. As used herein the term "sides" and the phrase "side walls" may be used interchangeably throughout the specification. In the illustrated embodiments, the platform 50 comprises a front left side wall and a front right side wall (51*a*, 51*e*, respectively); however, in some embodiments the platform may comprise a single, continuous front side wall. The front (51*a*, 51*e*) and rear 51*c* side walls are connected at respective ends to the left 51*b* and right 51*d* side walls so as to form a perimeter. In one embodiment, the front left 51*a*, left 51*b*, rear 51*c*, right 51*d*, and front right 51*e* side walls are adjacent at their ends to form four (4) 90 degree angles such that the perimeter of the platform forms a square or rectangular shape. In some embodiments, at least two of the sides are further adjoined at their ends. For example, in the embodiment illustrated in FIG. 2, an end of the front right side 51*e* is adjacent to a first end of the right side 51*d* at a 90 degree angle to form one (1) of four (4) corners of the perimeter of the platform 50.

Top 50*a* and bottom 50*b* surfaces are defined within the perimeter. A first portion of the top surface 50*a* of the platform 50 defines a pole vault plant box 54' for receiving an end of a pole vault. The pole vault pant box 54' comprises a planar surface 54 that slopes relative to the top surface 50*a* of the frame 50, downward below ground level, as depicted in FIGS. 4 and 5. A second portion of the top surface 50*a* of the platform 50 defines one or more padding trays (52, 53) that are configured to receive the protective layer of padding 10.

The planar surface 54 of the pole vault plant box 54' is configured to receive the end of an athlete's vaulting pole and slopes downwardly, at an acute angle with respect to ground level, from the rear edge 53*c* of the padding tray 53 of the platform 50 (or, alternatively, from the first/front edge 54*a* of the planar surface, as described below) towards the rear side 51*c* of the platform 50. Specifically, the planar surface 54 of the pole vault plant box 54' has a first and/or front edge 54*a* adjacent to rear edge 53*c* of the padding tray 53 of the platform 50, and the planar surface 54 extends downwardly at an angle relative to the top surface 50*a* of the platform toward the rear side 51*c* of the platform 50. In some embodiments, the planar surface 54 may extend from the edge 53*c* at a downward angle to a depth of approximately 8.25 inches below the top surface 50*a* of the platform; it being understood, however, that any desired angle and depth can be used based on the requirements of any pole vaulting regulations. As used herein the term "sides" and the phrase "side edges" may be used interchangeably throughout the specification. As used herein the terms "edge" and "end" may be used interchangeably throughout the specification.

As illustrated in FIG. 3, the planar surface 54 of the pole vault plant box 54' may consist of first/front and second/rear edges (54*a*, 54*c*) and a right and a left side edge (54*b*, 54*d*) wherein the length of the first/front edge 54*a* is greater in length than the length of the second/rear edge 54*c*, such that when adjoined by the right and left sides (54*b*, 54*d*) the planar surface 54 forms a trapezoidal shape, and wherein the second/rear edge 54*c* and at least a portion of the right and left sides (54*b*, 54*d*) of the planar surface 54 are positioned below ground level. In one embodiment, the length of the first end 54*a* may be additionally defined by, or vice versa define, the length of the rear edge 53*c* of the padding tray 53 (not shown in FIG. 3) of the platform 50.

Extending upward from the right and left sides (54*b*, 54*d*) of the planar surface 54 are respective left and right side walls (55*a*, 55*c*). Extending from the second/rear edge 54*c* of the planar surface 54 is a rear wall 55*b*. Side walls 55*a* and 55*c* extend upwardly and outwardly from the sides of the planar surface 54, at an angle greater than or equal to 90 degrees with respect to the sides (54*d*, 54*b*, respectively) of the planar surface 54 of the pole vault plant box 54', and towards the left 51*b* and right 51*d* sides, respectively, of the platform 50. The rear wall 55*b* extends upwardly and outwardly at an angle, with respect to the planar surface 54, from the second/rear end 54*c* of the planar surface 54 and towards the rear end 51*c* of the platform 50. In an exemplary embodiment, the top edges of the side walls (55*a*, 55*c*) and the rear wall 55*b* extend beyond the top surface 50*a* of the platform 50; however, in an alternative embodiment, the top edges of the side walls (55*a*, 55*c*) and the rear wall 55*b* may be flush or planar with the top surface 50*a* of the platform 50.

In one embodiment, the rear ends of the left 55*a* and right 55*c* side walls may be adjacent to opposed ends of the rear wall 55*b* and separated by a distance equivalent to the length of the second/rear end 54*c* of the planar surface 54. The front ends of the left 55*a* and right 55*c* side walls extend to the front edge 54*a* of the planar surface 54. In this configuration, the left 55*a* and right 55*c* side walls form a triangular shape wherein the intersection between the front ends of the side walls (55*a*, 55*c*) and the front edge 54*a* of the planar surface 54 define single vertices' of the triangular shape and form an acute angle extending rearwardly toward the rear wall 55*b* and upwardly with respect to the planar surface 54 of the pole vault plant box 54'.

As mentioned, the left and right side walls (55*a*, 55*c*) and rear wall 55*c* extend upwardly relative to the planar surface 54 at selected angles. This distance of extension and angle of extension for each respective wall may be in compliance with standard pole vaulting rules and regulations or at any desired height to accommodate at the end of a pole vault and sufficiently retain the pole during a vaulting procedure. For example, the side walls 55*a* and 55*b* typically extend from the planar surface 54 at an angle in the range of 30 to 45 degrees with respect to the planar surface 54, and the rear wall 55*b* is at angle in the range of 100 to 105 degrees with respect to the planar surface 54. In an exemplary embodiment, the platform 50 comprises set dimensions for the length of the platform 50, the length of the planar surface 54, and the depth of the planar surface such that the rear wall 55*b* is at angle in the range of 105 degrees with respect to the planar surface 54.

One or more padding trays may be formed in the top surface 50*a* of the platform 50 and may be stamped, cast, or formed via another method. In the illustrated embodiments, first 52 and second 53 padding tray are formed in the top surface 50*a* of the platform 50. In one embodiment, as depicted in FIG. 1, the padding tray may include multiple trays such as left- and right-side padding trays and a rear padding tray. The padding tray may be of any shape including but not limited, rectangular, squared, circular, trapezoidal, organic and/or ameba shapes. In the illustrated embodiments, the first padding tray 52 is U-shaped and the second padding tray 53 is trapezoidal in shape.

The second padding tray 53 may be defined by a padding tray planar surface 53*e* having a front and rear edge (53*a*, 53*c*, respectively), and a left and right side edge (53*b*, 53*d*, respectively) with walls (56*a*-56*c*) extending respectively therefrom. Extending upward from the left and right sides (53*b*, 53*d*) of the second padding tray 53 are respective left and right side walls (56*a*, 56*c*). Extending upward from the rear end 53*c* of the padding tray planar surface 53*e* of the second padding tray 53 is a rear wall 56*b*. The side walls 56*a*, 56*c* may extend upwardly and outwardly from the sides of the padding tray planar surface 53*e* of the second padding tray 53, at an angle greater than or equal to 90 degrees with respect to the sides (53*b*, 53*d*) of the padding tray planar surface 53*e* of the second padding tray and towards the left 51*b* and right 51*d* sides, respectively, of the platform 50. The rear wall 56*b* extends upwardly, with respect to the padding tray planar surface 53*e* of the second padding tray 53, from the rear end 53*c* of the padding tray planar surface 53*e* of the second padding tray 53 and towards the top surface 50*a* of the platform 50. The front edge 53*a* of the padding tray 53 is adjacent to and centered between the bottom edge of the front left 51*a* and front right 51*e* side walls of the platform 50, and the padding tray planar surface 53*e* of the second padding tray 53 extends downwardly at an angle relative to the top surface 50*a* of the platform 50 toward the front edge 54*a* of the planar surface 54 of the pole vault plant box 54'. The padding tray planar surface of the second padding tray 53 may extend downward at any desired angle and depth based on the configuration of the assembly and shape of the protective layer of padding 10.

In an exemplary embodiment, the top edges of the side walls (56*a*, 56*c*) and the rear wall 56*b* extend to the top surface 50*a* of the platform 50 such that the edges of the walls are flush with the top surface 50*a* of the platform 50; however, in an alternative embodiment, the top edges of the side walls (56*a*, 56*c*) and the rear wall 56*b* may extend beyond the top surface 50*a* of the platform 50. In one embodiment, the rear ends of the left 56*a* and right 56*c* side walls may abut the rear wall 56*b* and be separated from each other by a distance equivalent to the length of the rear end 53*c* of the padding tray planar surface 53*e* of the second padding tray 53, and the front ends of the left 54*a* and right 54*c* side walls may respectively intersect the front edge 53*a* of the second padding tray 53, such that the left 56*a* and right 56*c* side walls form a triangular shape wherein the intersection between the front edge of the side walls (56*a*, 56*c*) and the front edge 53*a* of the second padding tray 53 may define single vertices of the triangular shape and the top and bottom edges of the side walls (56*a*, 56*c*) respectively form an acute angle extending upwardly with respect to the padding tray planar surface 53*e* of the second padding tray 53. The angle at which the side walls (56*a*, 56*c*) and rear wall 56*b* extend upwardly relative to the padding tray planar surface 53*e* of the second padding tray 53 may be in compliance with standard pole vaulting rules and regulations or at any desired angled to accommodate the widthwise dimensions of the front edge 54*a* of the planar surface 54, which receives the end of a pole vault and sufficiently retain the pole during a vaulting procedure.

As is discussed above, the left, right, and rear, side walls (55*a*, 55*c*, and 55*b* respectively) extend at angles upwardly from the planar surface 54 of the pole vault plant box 54'. As shown in FIGS. 1 and 2, the left and right side walls (55*a* 55*c*, respectively) extend at angles α horizontally from the respective ends 54*b* of the planar surface, respectively toward the left and right side walls 51*b* and 51*d* of the frame 50, thereby creating horizontally slanted walls 55*a* and 55*c* that angle from the front edge 54*a* to the rear edge 54*c* of the planar surface 54 of the pole vault plant box 54'. As illustrated in FIG. 1, the left and right side walls 56*a* and 56*c* of the second padding tray 53 extend upwardly from the padding tray planar surface 53*e* at an angle. Further, the left and right side walls (56*a* 56*c*, respectively) extend at angles β horizontally from the respective ends 53*c* of the padding tray planar surface 53*e*, respectively toward the left and right side walls 51*b* and 51*d* of the frame 50, thereby creating horizontally slanted walls 56*a* and 56*c* that angle from the front edge 53*a* to the rear edge 53*c* of the planar surface 53*e* of the second padding tray 53. As illustrated in FIGS. 1 and 2, the rear ends of the left and right side walls 56*a* and 56*c* of the second padding tray 53 are offset horizontally by a distance 60 from the respective front ends of the left and right side walls 55*a* and 55*c* of the planar surface 54 of the pole vault plant box 54'. This offset accounts for the thickness of the padding 12 covering the second padding tray 53, so that the top surface of the padding 12 is flush with the planar surface 54 of the pole vault plant box 54', and the padding 12 and the planar surface 54 form a trapezoidal shaped opening with angled side and back walls for receiving the end of a pole vault.

The first and second padding trays (52, 53, respectively) typically have planar top surfaces defined within the perimeter of the top surface 50*a* of the platform 50. In some embodiments, the planar top surfaces of the padding trays (52, 53) are positioned parallel to the ground level, and in other embodiments, the planar top surfaces of the padding trays (52, 53) are positioned at an angle with respect to the ground level. These padding trays are typically configured to receive a protective layer of padding 10 and may form a recess with respect to the top surface 50*a* and perimeter (51*a*-51*e*) of the platform 50. The padding trays (52, 53) may be configured to receive the protective layer of padding 10 such that the protective layer of padding may be positioned adjacent to the top surface of the padding trays (52, 53) and at least a portion of the protective layer of padding 10 completely fills the recess formed by the padding trays (52, 53). Other configurations of padding may include a number of separate padding units opposed to one continuous layer of padding.

Referring again to FIG. 1, the top surfaces of the padding trays (52, 53) are configured to receive padding 10. To maintain the padding in place, the padding trays may include couplings such as pins, screws, an adhesive, Velcro®, a lock, a tab, a compressed pin, or the like for engaging the padding. The padding 10 is also configured for attachment to the padding trays. In some embodiments, as depicted in FIGS. 1 and 2, bottom surfaces of the padding 10 may include a rigid form that provides structure to the padding 10 as well as a solid surface for coupling the padding 10 to the padding trays. The bottom surface of the padding 10 may be coupled to the padding tray via couplings such as pins, screws, an adhesive, Velcro®, a lock, a tab, a compressed pin, or the like.

In addition to the rigid bottom form, the padding 10 may be constructed from foam, molded foam, or cushion and upholstered or skinned with a fabric which will contain the foam in its required shape while providing resistance to damage from impacts of the vaulting pole or the athlete's cleats. Thickness of the padding 10 may range between 3.5 to 4 inches, or may be another thickness. Typically, the top surface of the padding 10 is flush with the top surface of the platform 50, which is typically flush with ground level as depicted in FIGS. 4 and 5.

In general, the padding 10 may be configured to conform to the shape of the respective padding trays (52, 53). Furthermore, the padding may conform to the angles of the side walls 56*a* and 56*c*, the rear wall 56*b*, and, the extended side walls of the planar surface 54 (55*a*-55*c*). For example, an inner upright surface 11 of the padding 10 may be angled to conform with the angle of the respective side walls 56*a* and 56*c*, and be further angled such that when the padding 10 is positioned adjacent to the top surface 50*a* of the padding trays (52, 53) the upright surface 11 is flush with, and adjacent to, the side wall 55*a*.

A planar padding surface 12 within the padding 10 may be flush with, and adjacent to, the planar surface 54. In this embodiment, the planar padding surface 12 may include an inner wall 13 that defines a thickness of the pad and fits adjacent to the rear wall 53*c* of the padding tray 53 such that it is positioned below ground level. As illustrated in FIG. 2, the planar padding surface 12 is angled to conform to the angle of the second padding tray 53, so as to conform to the second padding tray 53. It is positioned so that a top surface of the planar padding surface 12 associated with the second padding tray 53 is flush with the planar surface 54 so as to form a continuous angled surface from the front edge 53*a* of the second padding tray 53 to the rear edge 54*c* of the planar surface 54. In this configuration, not only are the right, rear, and left walls 55*a*-55*c* extending from the planar surface 54 protected with padding 10, 11, but the area in front of planar surface defined by the front edge 54*a* of the planar surface 54 protected by padding 12. The protection padding surface 12 is angled as discussed above so as to provide protection in front of the planar surface 54, while also not obstructing the entrance of the end of a pole vault pole as it is inserted in the area defined by the planar surface 54.

As illustrated in FIGS. 1-5, the platform 50 is connected to a support frame 90, which is used to support the platform 50 of the plant box assembly 1 within the ground or other rigid structure. The support frame may be manufactured from a rigid material such as a metal, a metal alloy, titanium, aluminum, steel, iron, plastic, fiberglass, carbon fiber, or a composite. The support frame includes a substantially Z-shaped frame having a top and bottom surface (90*a*, 90*b*, respectively), and front and rear walls (91*a*, 91*b*, respectively). The front and rear walls (91*a*, 91*b*, respectively) may additionally have a plurality of protrusions 92 extending therefrom that further anchor the support frame 90 within the ground. The first or front side wall 91*a* extends downward from the bottom surface 90*b* further into the ground, and away from the platform 50, and the second or rear wall 91*b* extends up the top surface 90*a* towards the platform 50. As illustrated, the planar surface 54 of the platform 50 extends into the support frame 90 such that the planar surface 54 is adjacent and flush with the top surface 90*a* of the support frame 90, the rear wall 55*b* is adjacent to the rear wall 91*b* of the support frame, and the rear wall 56*b* of the second padding tray 53 is adjacent to at least a portion of the front wall 91*a* of the support frame. In one embodiment, the support frame 90 may be coupled to and/or include one or more offset tabs located on the sides of the frame and extending from a top surface thereof. The offset tabs may be operatively coupled to the support frame 90 via couplings such as pins, screws, an adhesive, a lock, a tab, a compressed pin, or the like. Typically positioned on opposite parallel sides of the top surface of the support frame 90, the offset tabs may provide added height to the support frame 90 so that top surface 90*a* and the rear wall 91*b* of the support frame is configured to receive at least part of the platform 50. As such, the offset tabs allow the frame to be positioned at a desired depth in the ground of other rigid structure while providing clearance for the downward angle of the planar surface 54 of the platform 50.

As illustrated in FIGS. 4 and 5, once the support frame 90 is properly positioned in the ground, concrete, cement, an epoxy, or another similar adhesive substance may be poured around the support frame to ensure a secure and permanent coupling between the support frame and the ground. Alternative, additional supporting components may be coupled with the support frame. When properly installed, the support frame 90 is recessed in the ground such that it is below ground level as depicted in FIGS. 4 and 5. Upon installation, the platform 50 may be recessed into the ground so that the top surface 50*a* of the platform 50 is flush with ground level as illustrated in FIGS. 4 and 5.

During operation, the pole vault plant box assembly 1 may be operatively adjacent to a landing pad that used by the athlete when landing after undertaking a pole vaulting jump. In some embodiments, the landing pad may be placed adjacent to or on top of the padding 10 so that the landing pad substantially overlaps the top surface of the padding 10, which is typically flush with ground level. An optional collar of additional padding may be installed such that the top surface of the optional collar of additional padding or the top surface of the optional collar of additional padding may be flush with the top surface of the landing pad. Such a configuration may create a seamless protective landing surface for the athlete, thus reducing potential injuries in the event that the athlete falls in a space between the landing pad and the plant box assembly 1.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

What is claimed is:

1. An assembly for engaging an end of a vaulting pole, said assembly comprising:

a support frame configured to be at least partially recessedly installed in a ground; and a platform comprising a top surface comprising:

a pole vault plant box comprising an angled planar surface with left, rear, and right side walls extending upwardly from said planar surface, wherein the pole vault plant box is configured to enable receipt of an end of a vaulting pole during a pole vault plant;

at least one padding tray surrounding a perimeter of said pole vault plant box, wherein the padding tray is configured to receive a padding; and a bottom surface of the platform operatively coupled to the support frame, wherein a portion of said at least one padding tray is located adjacent to a front edge of said planar surface of said pole vault plant box, so as to accommodate padding in front of the pole vault plant box, wherein left and right side walls are defined in the padding tray and extend upwardly from a padding tray planar surface at an angle and extend at angles β horizontally from respective ends of a rear edge of the padding tray planar surface, respectively toward the perimeter of the padding tray, thereby creating horizontally slanted walls that angle from a front edge to the rear edge of the padding tray planar surface of the padding tray.

2. The assembly of claim 1, wherein a portion of said at least one padding tray is located adjacent to a front edge of said planar surface of said pole vault plant box, so as to accommodate padding in front of the pole vault plant box.

3. The assembly of claim 1, wherein the left, right, and rear side walls extend at angles upwardly from the planar surface of the pole vault plant box and the left and right side walls extend at angles a horizontally from respective ends of a rear edge of the planar surface, respectively toward to the perimeter of the padding tray, thereby creating horizontally slanted walls that angle from a front edge to the rear edge of the planar surface of the pole vault plant box.

4. An assembly for engaging an end of a vaulting pole, said assembly comprising:

a support frame configured to be at least partially recessedly installed in a ground; and a platform comprising a top surface comprising:

a pole vault plant box comprising an angled planar surface with left, rear, and right side walls extending upwardly from said planar surface, wherein the pole vault plant box is configured to enable receipt of an end of a vaulting pole during a pole vault plant;

at least one padding tray surrounding a perimeter of said pole vault plant box, wherein the padding tray is configured to receive a padding; and a bottom surface of the platform operatively coupled to the support frame, wherein the left, right, and rear, side walls extend at angles upwardly from the planar surface of the pole vault plant box and the left and right side walls extend at angles a horizontally from respective ends of a rear edge of the planar surface, respectively toward to the perimeter of the padding tray, thereby creating horizontally slanted walls that angle from a front edge to the rear edge of the planar surface of the pole vault plant box, wherein a portion of said at least one padding tray is located adjacent to a front edge of said planar surface of said pole vault plant box, so as to accommodate padding in front of the pole vault plant box, wherein left and right side walls are defined in the padding tray and extend upwardly from a padding tray planar surface at an angle and extend at angles β horizontally from respective ends of a rear edge of the padding tray planar surface, respectively toward the perimeter of the padding tray, thereby creating horizontally slanted walls that angle from a front edge to the rear edge of the padding tray planar surface of the padding tray, and wherein rear ends of the left and right side walls of the second padding tray are offset horizontally by a distance from respective front ends of the left and right side walls of the planar surface of the pole vault plant box.

5. The assembly of claim 1, wherein the platform defines front and rear sides connected by right and left sides so as to form a platform perimeter, wherein the at least one padding tray is defined within the platform perimeter, wherein the at least one padding tray comprises a first and a second padding tray.

6. The assembly of claim 5, wherein the first and second padding trays are recessed in respect to a top surface of the platform perimeter and are configured to receive at least one padding.

7. An assembly for engaging an end of a vaulting pole, said assembly comprising:

a support frame configured to be at least partially recessedly installed in a ground; and a platform comprising a top surface comprising:

a pole vault plant box comprising an angled planar surface with left, rear, and right side walls extending upwardly from said planar surface, wherein the pole vault plant box is configured to enable receipt of an end of a vaulting pole during a pole vault plant;

at least one padding tray surrounding a perimeter of said pole vault plant box, wherein the padding tray is configured to receive a padding; and a bottom surface of the platform operatively coupled to the support frame, wherein the platform defines front and rear sides connected by right and left sides so as to form a platform perimeter, wherein the at least one padding tray is defined within the platform perimeter, wherein the at least one padding tray comprises a first and a second padding tray, wherein said second padding tray is located adjacent to a front edge of said planar surface of said pole vault plant box, so as to accommodate padding in front of the pole vault plant box, and wherein the planar surface of the pole vault plant box has a first end adjacent a rear edge of the second padding tray, and wherein the planar surface extends downwardly at an angle from rear edge of the second padding tray toward the rear side of the platform perimeter.

8. The assembly of claim 7, wherein the platform comprises at least one side wall having an end connected to the planar surface, wherein the side wall is angled relative to the planar surface and extending upwardly and outwardly therefrom at an angle with respect to said planar surface from said planar surface and towards the top surface of the platform.

9. An assembly for engaging an end of a vaulting pole, said assembly comprising:

a support frame configured to be at least partially recessedly installed in a ground; and a platform comprising a top surface comprising:

a pole vault plant box comprising an angled planar surface with left, rear, and right side walls extending upwardly from said planar surface, wherein the pole vault plant box is configured to enable receipt of an end of a vaulting pole during a pole vault plant;

at least one padding tray surrounding a perimeter of said pole vault plant box, wherein the padding tray is configured to receive a padding; and a bottom surface of the platform operatively coupled to the support frame, wherein the platform defines front and rear sides connected by right and left sides so as to form a platform perimeter, wherein the at least one padding tray is defined within the platform perimeter, wherein the at least one padding tray comprises a first and a second padding tray, wherein the planar surface of the pole vault plant box has a first end adjacent a rear edge of the second padding tray, and wherein the planar surface extends downwardly at an angle from rear edge of the second padding tray toward the rear side of the platform perimeter, wherein the platform comprises at least one side wall having an end connected to the planar surface, wherein the side wall is angled relative to the planar surface and extending upwardly and outwardly therefrom at an angle with respect to said planar surface from said planar surface and towards the top surface of the platform, and wherein the at least one side wall extends for an extending portion above the top surface of the platform.

10. The assembly of claim 7, wherein the platform comprises a rear wall having an end connected to a second end of the planar surface, the rear wall extending upwardly with respect to the second end of said planar surface and towards the top surface of the platform.

11. The assembly of claim 10, wherein the rear wall extends for an extending portion above the top surface of the platform.

12. An assembly for engaging an end of a vaulting pole, said assembly comprising:

a support frame configured to be at least partially recessedly installed in a ground; and a platform comprising a top surface comprising:

a pole vault plant box comprising an angled planar surface with left, rear, and right side walls extending upwardly from said planar surface, wherein the pole vault plant box is configured to enable receipt of an end of a vaulting pole during a pole vault plant;

at least one padding tray surrounding a perimeter of said pole vault plant box, wherein the padding tray is configured to receive a padding; and a bottom surface of the platform operatively coupled to the support frame, wherein the platform defines front and rear sides connected by right and left sides so as to form a platform perimeter, wherein the at least one padding tray is defined within the platform perimeter, wherein the at least one padding tray comprises a first and a second padding tray, wherein said second padding tray is located adjacent to a front edge of said planar surface of said pole vault plant box, so as to accommodate padding in front of the pole vault plant box, and wherein said first padding tray is offset vertically above the second padding tray.

13. An assembly for engaging an end of a vaulting pole, said assembly comprising:

a support frame configured to be at least partially recessedly installed in a ground; and a platform comprising a top surface comprising:

a pole vault plant box comprising an angled planar surface with left, rear, and right side walls extending upwardly from said planar surface, wherein the pole vault plant box is configured to enable receipt of an end of a vaulting pole during a pole vault plant;

at least one padding tray surrounding a perimeter of said pole vault plant box, wherein the padding tray is configured to receive a padding; and a bottom surface of the platform operatively coupled to the support frame, wherein the platform defines front and rear sides connected by right and left sides so as to form a platform perimeter, wherein the at least one padding tray is defined within the platform perimeter, wherein the at least one padding tray comprises a first and a second padding tray, and wherein said second padding tray is located adjacent to a front edge of said planar surface of said pole vault plant box, so as to accommodate padding in front of the pole vault plant box; and padding located in the first and second padding trays, wherein at least a portion of the padding located in the second padding tray is thicker than at least a portion of the padding located in the first padding tray such that a top surface of the padding is substantially flush when installed in said platform.

14. The assembly of claim 5 further comprising padding located in the first and second padding trays, wherein the padding is continuous in form.

15. An assembly for engaging an end of a vaulting pole, said assembly comprising:

a support frame configured to be at least partially recessedly installed in a ground; and a platform comprising a top surface comprising:

a pole vault plant box comprising an angled planar surface with left, rear, and right side walls extending upwardly from said planar surface, wherein the pole vault plant box is configured to enable receipt of an end of a vaulting pole during a pole vault plant;

at least one padding tray surrounding a perimeter of said pole vault plant box, wherein the padding tray is configured to receive a padding; and a bottom surface of the platform operatively coupled to the support frame, wherein the platform defines front and rear sides connected by right and left sides so as to form a platform perimeter, wherein the at least one padding tray is defined within the platform perimeter, wherein the at least one padding tray comprises a first and a second padding tray, wherein said second padding tray is located adjacent to a front edge of said planar surface of said pole vault plant box, so as to accommodate padding in front of the pole vault plant box, wherein the planar surface of the pole vault plant box has a first end adjacent a rear edge of the second padding tray, and wherein the planar surface extends downwardly at an angle from rear edge of the second padding tray toward the rear side of the platform perimeter, wherein the platform comprises a rear wall having an end connected to a second end of the planar surface, the rear wall extending upwardly with respect to the second end of said planar surface and towards the top surface of the platform, and wherein the planar surface extends a downward angle such that when installed in the support frame the planar surface is adjacent to the top surface of the support frame, and a rear wall of the platform is adjacent to the rear wall of the support frame.

16. The assembly of claim 1, wherein the planar surface of the pole vault plant box is angled downward to a depth of 8.25 inches below a horizontal plane defined from the front edge of said planar surface of the pole vault plant box.

17. The assembly of claim 1, wherein the at least one padding tray includes means for coupling padding to said padding tray, wherein said means for coupling comprises at least one of a pin, a screw, an adhesive, Velcro®, a lock, a tab, and a compressing pin.

18. The assembly of claim 13, wherein the padding includes a layer of rigid material on its bottom surface so as to the enable the secure coupling of the padding to the platform, wherein said the padding is coupled to the platform via at least one of a pin, Velcro®, a lock, a compressing pin, a tab, an adhesive, and a screw.

19. The assembly of claim 1, wherein said support frame comprises:

a top surface and a rear wall configured to receive the bottom surface of the platform; and a bottom surface and a rear side wall configured to stabilize the support frame within the ground.

* * * * *